US006091008A

United States Patent [19]

Yu

[11] Patent Number: 6,091,008

[45] Date of Patent: Jul. 18, 2000

[54] GUITAR HANGER

[76] Inventor: Ming-Ti Yu, 58, Ma Yuan West St., Taichung, Taiwan

[21] Appl. No.: 09/370,901

[22] Filed: Aug. 9, 1999

[51] Int. Cl.[7] ..... G10D 3/00

[52] U.S. Cl. ..... 84/327; 248/220.41; 84/453

[58] Field of Search ..... 84/327, 421, 329, 84/453; 248/220.41, 220.31, 222.51, 289.11, 292.12

[56] References Cited

U.S. PATENT DOCUMENTS 3,765,633 10/1973 Caudill ..... 248/229.12
4,182,505 1/1980 Cobin ..... 248/220.41

*Primary Examiner*—Robert E. Nappi
*Assistant Examiner*—Shih-Yung Hsieh

[57] ABSTRACT

A guitar hanger has a support frame, an L-shaped plate disposed on the support frame, a 7-shaped tube engaging with the L-shaped plate, a sleeve, and a hanging device. The 7-shaped tube has a first arm and a second arm. At least a protrusion is disposed on an end of the second arm. The end of the second arm is inserted in the sleeve. The sleeve has at least an inner groove receiving the respective protrusion. The hanging device has a pipe receiving the sleeve, a hanging rod, and a connection joint connected to the pipe and the hanging rod. The support frame has a plurality of upward zigzag rods. The hanging rod has two upward blocking ends.

2 Claims, 5 Drawing Sheets

GUITAR HANGER

BACKGROUND OF THE INVENTION

The present invention relates to a guitar hanger. More particularly, the present invention relates to a guitar hanger which has a hanging device to be rotated.

A conventional guitar hanger is often positioned on a wall to hang a guitar. However, some guitars do not have symmetric shapes. Therefore, the center of gravity of the unsymmetrical guitar will deviate from a center line of the guitar. The unsymmetrical guitar will be hung slantwise and will be fallen down easily.

SUMMARY OF THE INVENTION

An object of the present invention is to provide a guitar hanger which has a hanging device to be rotated according to a center of gravity of a guitar hung on the hanging device.

Another object of the present invention is to provide a guitar hanger which has a hanging rod having two upward blocking ends to block a head portion of a guitar while the guitar is hung slantwise.

Accordingly, a guitar hanger comprises a support frame, an L-shaped plate disposed on the support frame, a 7-shaped tube engaging with the L-shaped plate, a sleeve, and a hanging device. The 7-shaped tube has a first arm and a second arm. At least a protrusion is disposed on an end of the second arm. The end of the second arm is inserted in the sleeve. The sleeve has at least an inner groove receiving the respective protrusion. The hanging device has a pipe receiving the sleeve, a hanging rod, and a connection joint connected to the pipe and the hanging rod. The support frame has a plurality of upward zigzag rods. The hanging rod has two upward blocking ends.

DETAILED DESCRIPTION OF THE INVENTION

Figure 1:
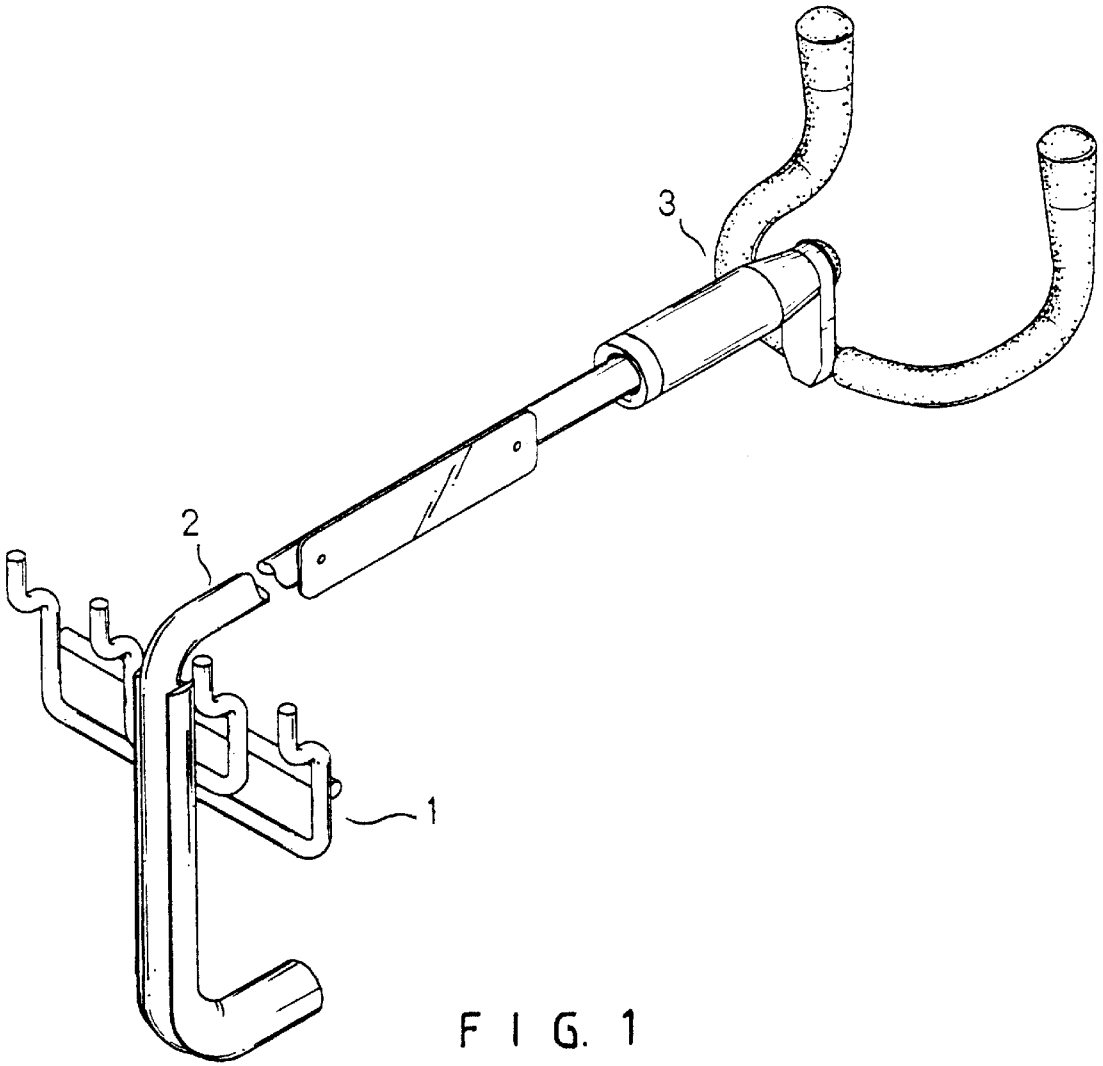
FIG. 1 is a perspective assembly view of a guitar hanger of a preferred embodiment in accordance with the present invention.
Figure 2:
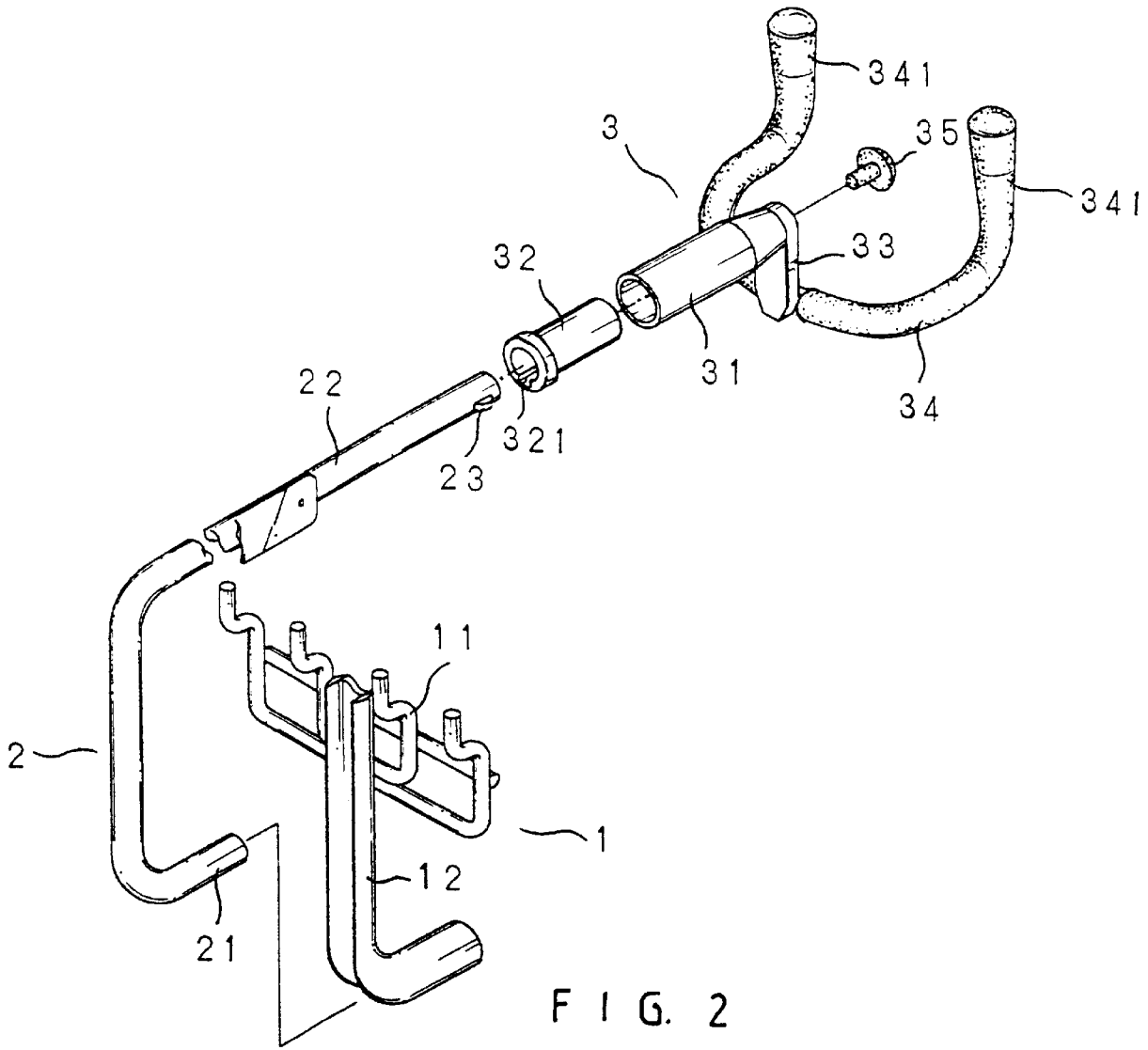
FIG. 2 is a perspective exploded view of a guitar hanger of a preferred embodiment in accordance with the present invention.
Figure 3:
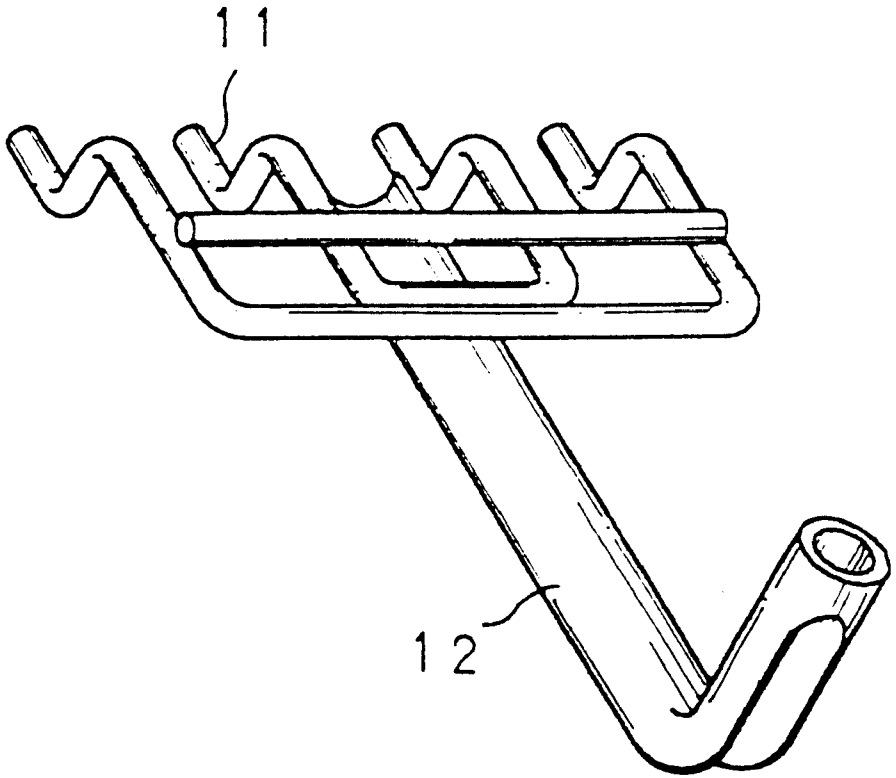
FIG. 3 is a perspective view of a support frame of a preferred embodiment in accordance with the present invention.

Referring to FIGS. 1 to 3, a guitar hanger comprises a support frame 1, an L-shaped plate 12 disposed on the support frame 1, a 7-shaped tube 2 engaging with the L-shaped plate 12, a sleeve 32, and a hanging device 3.

The 7-shaped tube 2 has a first arm 21 and a second arm 22. At least a protrusion 23 is disposed on an end of the second arm 22. The end of the second arm 22 is inserted in the sleeve 32.

The sleeve 32 has at least an inner groove 321 receiving the respective protrusion 23.

The hanging device 3 has a pipe 31 receiving the sleeve 32, a hanging rod 34, and a connection joint 33 connected to the pipe 31 and the hanging rod 34.

The hanging rod 34 has two upward blocking ends 341.

The support frame 1 has a plurality of upward zigzag rods 11 inserted in a plurality of holes of a wall or a plurality of meshes of a metal net (not shown in the figures).

An elastic plug 35 is disposed on the connection joint 33.

A head portion of a guitar (not shown in the figures) is hung on the hanging rod 34.

The upward blocking ends 341 of the hanging rod 34 block the head portion of the guitar while the guitar is hung slantwise.

Figure 5:
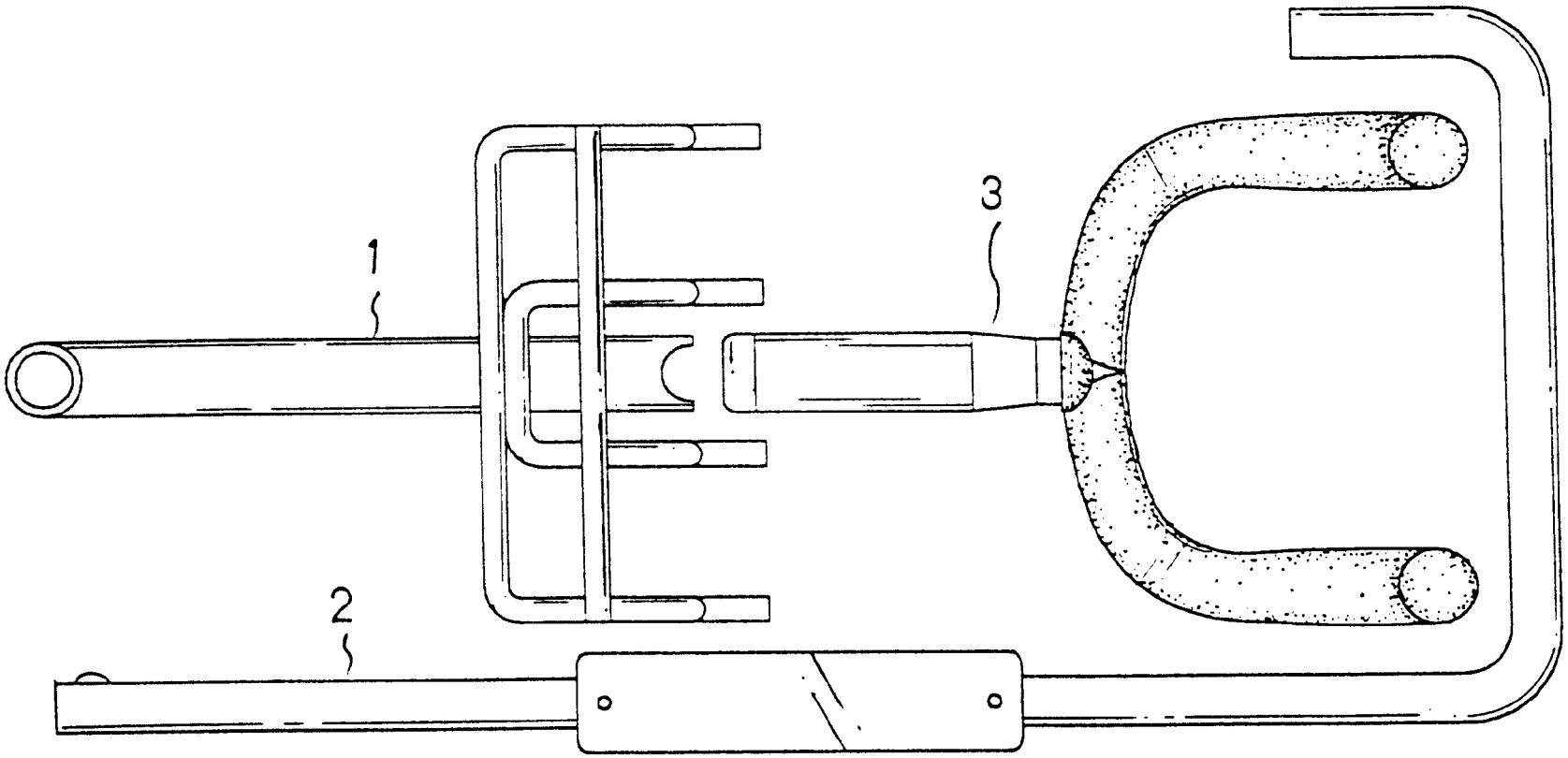
FIG. 5 is a schematic view illustrating a guitar hanger of a preferred embodiment is packed.

Referring to FIG. 5, the guitar hanger is detached and packed.

Figure 4:
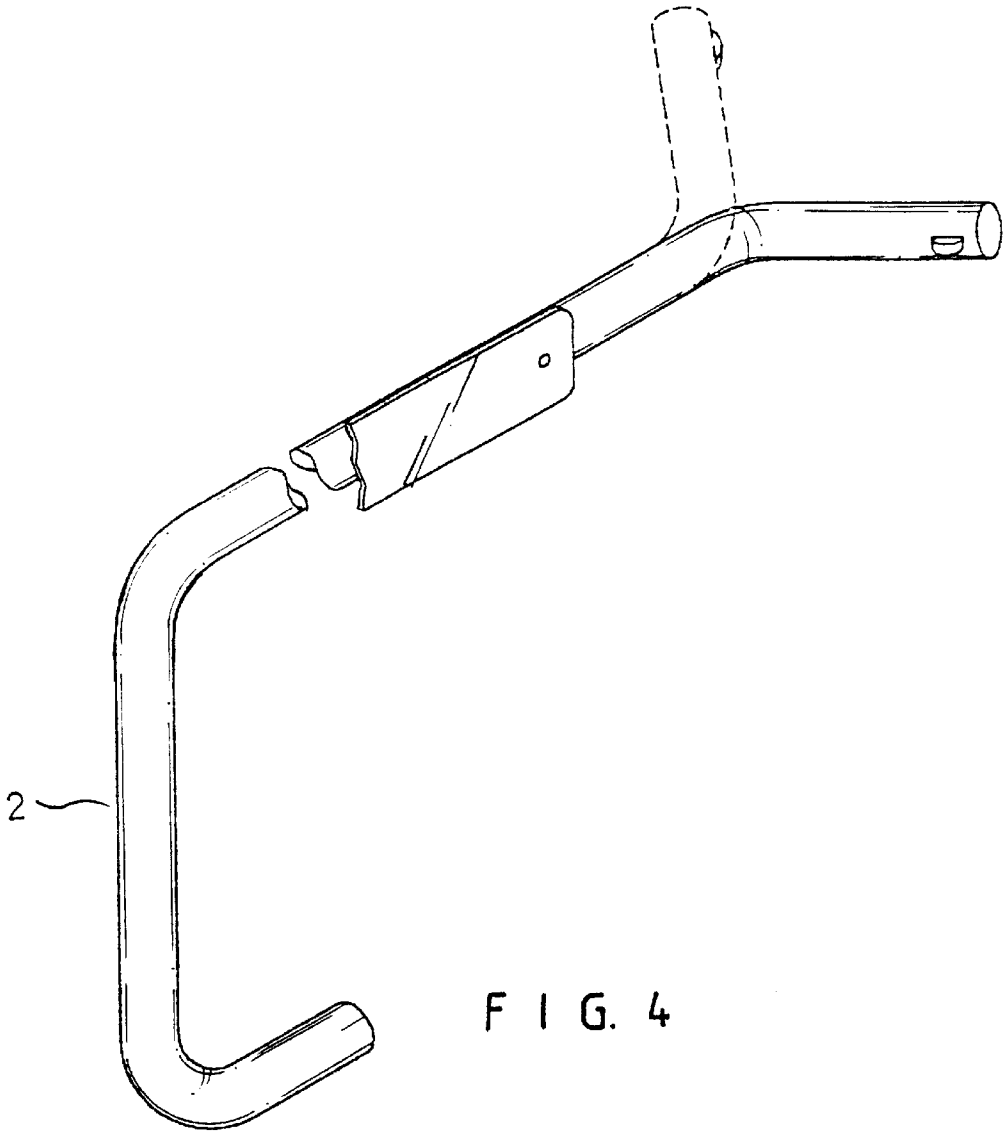
FIG. 4 is a perspective view of a variation of a 7-shaped tube.

Referring to FIG. 4, an end portion of the second arm 22 can be bent.

The present invention is not limited to the above embodiment but various modification thereof may be made. Furthermore, various changes in form and detail may be made without departing from the scope of the present invention.

I claim:

1. A guitar hanger comprises:

a support frame, an L-shaped plate disposed on the support frame, a 7-shaped tube engaging with the L-shaped plate, a sleeve, and a hanging device, the 7-shaped tube having a first arm and a second arm, at least a protrusion disposed on an end of the second arm, the end of the second arm inserted in the sleeve, the sleeve having at least an inner groove receiving the respective protrusion, the hanging device having a pipe receiving the sleeve, a hanging rod, and a connection joint connected to the pipe and the hanging rod, the support frame having a plurality of upward zigzag rods, and the hanging rod having two upward blocking ends.

2. A guitar hanger as claimed in claim 1, wherein an elastic plug is disposed on the connection joint.

* * * * *